United States Patent [19]

Froning et al.

[11] Patent Number: 4,529,037

[45] Date of Patent: Jul. 16, 1985

[54] METHOD OF FORMING CARBON DIOXIDE MIXTURES MISCIBLE WITH FORMATION CRUDE OILS

[75] Inventors: H. Robert Froning, Bixby; William F. Yellig, Jr., Tulsa, both of Okla.

[73] Assignee: Amoco Corporation, Chicago, Ill.

[21] Appl. No.: 600,631

[22] Filed: Apr. 16, 1984

[51] Int. Cl.[3] ..... E21B 43/16; E21B 43/40

[52] U.S. Cl. ..... 166/266; 166/267; 166/268

[58] Field of Search ..... 166/266, 267, 268, 273, 166/274

[56] References Cited

U.S. PATENT DOCUMENTS

| | | | |
|---|---|---|---|
| 2,875,830 | 3/1959 | Martin | 166/266 |
| 2,875,832 | 3/1959 | Martin et al. | 166/266 |
| 3,075,918 | 1/1963 | Holm | 166/268 X |
| 3,623,552 | 11/1971 | Vairogs | 166/274 |
| 3,653,438 | 4/1972 | Wagner | 166/266 |
| 3,811,501 | 5/1974 | Burnett et al. | 166/273 X |
| 3,811,503 | 5/1974 | Burnett et al. | 166/273 X |

OTHER PUBLICATIONS

Yellig et al., "Determination and Prediction of $CO_2$ Minimum Miscibility Pressures", *Journal of Petroleum Technology*, Jan. 1980, pp. 160–168.

Henry, "Multiple Phase Generation During $CO_2$ Flooding", SPE 8812, 1980.

Metcalfe, "Effects of 'Impurities' on Minimum Miscibility Pressures and Minimum Enrichment Levels for $CO_2$ and Rich Gas Displacements", SPE 9230, 1980.

*Primary Examiner*—George A. Suchfield

*Attorney, Agent, or Firm*—Robert R. Cochran

[57] ABSTRACT

A method is disclosed for forming a carbon dioxide-containing mixture which is miscible with crude oil. The method comprises maintaining a mixture of crude oil and carbon dioxide in an extraction zone at a temperature and pressure such that multiple phase equilibrium is achieved therebetween. A carbon dioxide-rich phase that includes a mixture of carbon dioxide and hydrocarbons is withdrawn and is miscible with the reservoir crude oil when injected into the reservoir from which the crude oil was produced.

3 Claims, 1 Drawing Figure

METHOD OF FORMING CARBON DIOXIDE MIXTURES MISCIBLE WITH FORMATION CRUDE OILS

FIELD OF THE INVENTION

This invention relates to the recovery of crude oil from crude oil-bearing subterranean reservoirs. Particularly, this invention relates to a process for the formation of carbon dioxide-hydrocarbon mixtures which will mix in all proportions with crude oil from a subterranean reservoir at the ambient temperature and pressure of the reservoir. In another aspect, this invention relates to forming a carbon dioxide-hydrocarbon mixture from carbon dioxide and crude oil.

BACKGROUND OF THE INVENTION

In the recovery of the crude oil from underground reservoirs, one known method includes the injection of a solvent into the reservoir to displace the crude oil through the reservoir. When solvents are employed that will mix in all proportions with crude oil at the ambient temperature and pressure of the reservoir from which the crude oil is produced, the term "miscible flooding" is applied to the process. The process of miscible flooding can be extremely effective in stripping and displacing oil through the reservoir. Miscible fluids which have been used include light hydrocarbons and mixtures thereof, such as paraffins in the $C_2$–$C_6$ range, and in particular, liquid petroleum gas (LPG). However, miscible flooding with LPG has not become widespread because of the ready market and high value of LPG, making miscible LPG projects uneconomic.

In another process for the recovery of crude oil from underground reservoirs, a crude oil displacing fluid which is not miscible with the crude oil at the ambient temperature and pressure of the reservoir but which will develop miscibility with the crude oil is injected into the reservoir to displace the crude oil contained in the reservoir. The term "miscible flooding" is also applied to this process. This sort of miscible flooding is termed "developed miscibility," or "multiple-contact miscibility," wherein it is thought that the intermediates ($C_2$–$C_6$) of crude oil transfer into the crude oil displacing fluid over a sustained period of exposure, as opposed to "first-contact miscibility," wherein a zone of contiguously miscible fluids will result.

A mixture of crude oil and a crude oil displacing fluid that will develop miscibility with the crude oil have been observed to form three phase systems when maintained at the temperature and pressure of the reservoir from which the crude oil was produced. The three-phase system comprises an upper vapor phase rich in the miscibility-generating solvent, a middle-phase liquid also rich in the miscibility-generating solvent, and an oil-rich liquid lower phase. A solid asphaltene phase which coexists with the vapor and liquid phases has been observed in some cases.

Carbon dioxide, which is relatively inexpensive compared to LPG, has been used as an oil-recovery solvent. Carbon dioxide is miscible with crude oil in certain reservoirs, but usually at a reservoir pressure less than about 2,000 psia at ambient reservoir temperatures. The minimum pressure at which carbon dioxide is miscible with crude oil from a reservoir is determined at the ambient reservoir temperature and is referred to as the minimum miscibility pressure (MMP).

Carbon dioxide can be mixed with hydrocarbons to produce a displacing fluid that develops miscibility with the crude oil being displaced at the ambient temperature and pressure of the reservoir when the pressure of the reservoir to be flooded lies below the pure carbon dioxide minimum miscibility pressure. Processes utilizing these methods are disclosed in U.S. Pat. Nos. 3,811,501 and 3,811,503, both issued to D. Burnett, et al., on May 21, 1974.

The processes described to produce such carbon dioxide mixtures require mixing carbon dioxide with the required hydrocarbon. The hydrocarbon is expensive and, in some cases, unavailable at field locations.

Other pertinent publications include "Multiple Phase Generation During Carbon Dioxide Flooding", R. L. Henry and R. S. Metcalfe, SPE/DOE Symposium on Enhanced Oil Recovery, Apr. 20–23, 1980 (SPE Paper No. 8812), and "Determination and Predictability of Carbon Dioxide Minimum Miscibility Pressures", W. F. Yellig and R. S. Metcalfe, Journal of Petroleum Technology, January, 1980, pages 160–167, and "Effects of Impurities on Minimum Miscibility Pressure and Minimum Enrichment Levels for $CO_2$ and Rich Gas Displacements", R. S. Metcalfe, SPE Annual Meeting, 1980 (SPE Paper No. 9230). These publications describe the methods of determining minimum miscibility pressure and multiple phase miscibity.

SUMMARY OF THE INVENTION

Over limited temperature, pressure and composition ranges, mixtures of carbon dioxide and crude oil exhibit a complex phase equilibria in which a carbon dioxide-rich vapor phase, a carbon dioxide-rich liquid phase, an oil-rich liquid phase, and, in some cases, a solid asphaltene phase, coexist in equilibrium. This invention utilizes this phase equilibria in a novel process to obtain a carbon dioxide-hydrocarbon mixture useful for injection into a reservoir to miscibly displace crude oil. More particularly, the invention relates to the mixture produced from the interaction of a carbon dioxide and crude oil. The process includes contacting the carbon dioxide with the formation crude oil in an extraction zone which is maintained at a temperature and pressure such that multiple phases occur. Included in these phases are carbon dioxide rich phases which contain hydrocarbons extracted from the crude oil. These carbon dioxide rich phases are used to miscibly displace crude oil through subterraneous reservoirs.

DETAILED DESCRIPTION OF THE INVENTION

Figure 1:
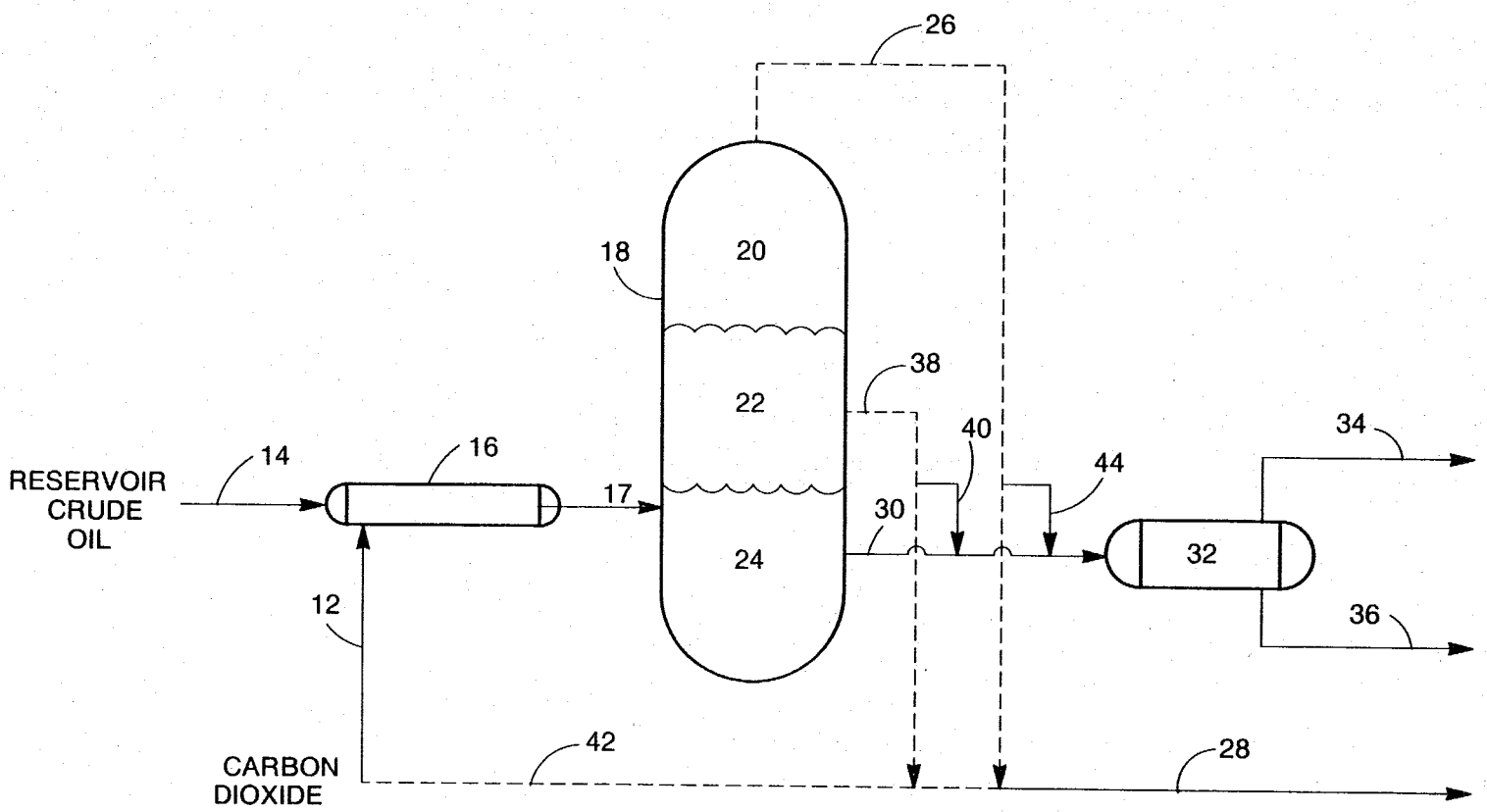
FIG. 1 illustrates a schematic diagram for the formation of a carbon dioxide displacement fluid which is miscible with a formation crude oil.

It has heretofore been believed that the only method of decreasing the minimum miscibility pressure (MMP) of carbon dioxide with crude oil was by bringing an additive such as intermediate hydrocarbons to the injection site for addition to the carbon dioxide, an expensive and time consuming process. However, we have discovered that by contacting the carbon dioxide with crude oil produced from the reservoir to undergo a carbon dioxide miscible flood, under appropriate conditions, a mixture of carbon dioxide and hydrocarbons is generated that is suitable for injection into the formation for miscible displacement of crude oil.

The concentrations of carbon dioxide and additive necessary to develop miscibility between the carbon dioxide/additive mixture and the reservoir crude oil at ambient reservoir pressures and temperatures can be determined by means of a slim tube displacement test which is well known in the art and described in the publications cited above by Yellig and Metcalfe, and Henry and Metcalfe.

Referring now to FIG. 1, as using for purposes of illustration the case where carbon dioxide is not miscible, at ambient reservoir conditions, with crude oil produced from a subterranean reservoirs. The miscibility of the carbon dioxide with the crude oil is adjusted by addition of hydrocarbons to develop miscibility, carbon dioxide via line 12 is mixed with crude oil introduced via line 14 into a mixing conduit 16. The mixed stream is introduced into an extraction zone, in the form of an extraction vessel 18, which is a pressure vessel operated under suitable conditions of pressure and temperature to assure the formation of a plurality of fluid phases. Pressure and temperature in the extraction vessel 18 are maintained such that the concentration of hydrocarbons in the carbon dioxide-rich phase is in excess of the concentration required for the carbon dioxide-rich phase to develop miscibility with the crude oil at the ambient pressure and temperature of the reservoir from which the crude oil was produced. Within the extraction vessel 18, a carbon dioxide-rich gaseous phase 20, carbon dioxide-rich liquid phase 22 and an oil-rich liquid phase 24 are illustrated. The gaseous phase 20, comprising carbon dioxide and hydrocarbons is withdrawn from extraction vessel 18 via line 26, and is transported to line 28 which conducts the miscible fluid to a wellhead for injection into the reservoir from which the crude oil was produced.

Phase 24, which may contain some carbon dioxide, is removed from extraction vessel 18 via line 30 and is introduced into a flash separator 32. In the flash separator 32, pressure is reduced and whatever carbon dioxide is present in stream 30 is vaporized and exits via line 34 with entrained methane. This stream can be sent to a gas plant for carbon dioxide stripping with the methane ultimately being sold or used on site for fuel. A stream of crude oil is recovered via line 36 for eventual sale as separator oil. The carbon dioxide in line 26 may be recycled to vessel 18 through line 12 or withdrawn via line 28 for injection. The carbon dioxide-containing liquid phase 22 can be introduced into line 30 via line 40 and flash separated in the flash tank 32 into carbon dioxide and hydrocarbon components.

The carbon dioxide containing gaseous phase 20 may contain a concentration of intermediate hydrocarbons which exceeds the concentration required for miscibly mixing with the crude oil. This phase withdrawn in line 26 may then be blended with a quantity of carbon dioxide via line 42 such that line 28 contains the carbon dioxide mixture desired for miscible flooding.

While either the upper or middle carbon dioxide-rich phases can be utilized for miscible oil recovery, it is contemplated that the carbon dioxide-rich liquid middle phase is preferred since most of the methane absorbed by the carbon dioxide will be contained in the upper phase 20. Methane tends to increase the MMP of carbon dioxide. The total amount of methane is anticipated to be small since line 14 will contain flashed separator oil.

In either case, the appropriate fluid is withdrawn from vessel 18 and is transported to line 28 which conducts the crude oil displacing fluid to a wellhead for injection into the reservoir.

In the embodiment wherein the carbon dioxide-rich gaseous phase 20 is not used in the miscible flooding, it is withdrawn in line 26, and introduced into line 30, containing the oil-rich liquid phase 24 via line 44. In the embodiment wherein the carbon dioxide-rich liquid phase 22 is maintained at a concentration of hydrocarbons such that the carbon dioxide-rich liquid phase 22 withdrawn through line 38 contains excess hydrocarbon than is required for the phase 22 to be miscible with the formation crude oil, it can be blended with additional carbon dioxide. This is illustrated by phase 22 being withdrawn in line 38 and blended with a quantity of carbon dioxide delivered through line 42 such that line 28 contains a carbon dioxide mixture having a concentration of hydrocarbons such that the mixture is miscible with the formation crude oil.

Reasonable variations and modifications which will become apparent to those skilled in the art can be made in the present invention without departing from the spirit and scope thereof.

We claim:

1. A method of preparing a crude oil displacing fluid for injection into an oil-bearing subterranean reservoir to displace crude oil through the reservoir comprising mixing crude oil from said reservoir with carbon dioxide; introducing the mixture of crude oil and carbon dioxide into an extraction zone maintained at the temperature and pressure to produce a carbon dioxide-rich vapor phase, a carbon dioxide-rich liquid phase, and an oil-rich liquid phase; removing said carbon dioxide-rich liquid phase from said extraction zone and using same as said displacing fluid and passing said oil-rich liquid phase and said vapor phase to a separator wherein the phases are separated into crude oil and a carbon dioxide containing stream.

2. The process of claim 1 wherein the carbon dioxide-rich liquid phase comprises carbon dioxide and a sufficient concentration of a hydrocarbon component such that the carbon dioxide-rich phase will develop miscibility with the crude oil at the ambient temperature and pressure of the reservoir.

3. The process of claim 2 wherein said hydrocarbon component contains at least one of the group consisting of methane, ethane, propane, butane, heptane, and hexane.

* * * * *